US009676458B2

(12) United States Patent
VanNimwegen

(10) Patent No.: US 9,676,458 B2
(45) Date of Patent: Jun. 13, 2017

(54) WATERCRAFT WITH UNDERCUT GRIP INSERT

(71) Applicant: Lifetime Products, Inc., Clearfield, UT (US)

(72) Inventor: Edward VanNimwegen, North Ogden, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

(21) Appl. No.: 14/558,090

(22) Filed: Dec. 2, 2014

(65) Prior Publication Data

US 2016/0152306 A1 Jun. 2, 2016

(51) Int. Cl.

| | |
|---|---|
| ***B63B 35/00*** | (2006.01) |
| ***B63B 35/71*** | (2006.01) |
| ***B63C 13/00*** | (2006.01) |
| ***B63B 35/79*** | (2006.01) |
| *B63B 17/00* | (2006.01) |
| *B63B 5/24* | (2006.01) |

(52) U.S. Cl.

CPC ..... *B63C 13/00* (2013.01); *B63B 35/7946* (2013.01); *B63B 35/71* (2013.01)

(58) Field of Classification Search

CPC ..... B63B 5/24; B63B 35/71; B63B 5/7906; B63B 7/04; B63B 5/731

USPC ..... 114/347, 355, 357, 364

See application file for complete search history.

(56) References Cited

U.S. PATENT DOCUMENTS

| | | | | |
|---|---|---|---|---|
| 4,090,756 | A | 5/1978 | Frey et al. | |
| 4,699,076 | A | 10/1987 | Curtis et al. | |
| 5,397,525 | A | 3/1995 | Niemier | |
| 6,073,574 | A * | 6/2000 | King | B63B 35/71 114/201 R |
| 6,349,662 | B1 | 2/2002 | Limansky et al. | |
| 6,401,648 | B1 | 6/2002 | Abbenhouse | |
| 6,932,011 | B2 | 8/2005 | Nagata et al. | |
| 6,990,920 | B2 | 1/2006 | Hamilton et al. | |
| 7,032,531 | B1 | 4/2006 | Caples | |
| 7,121,225 | B1 * | 10/2006 | Caples | B63B 19/14 114/347 |
| 7,320,291 | B2 | 1/2008 | Eckert | |

(Continued)

FOREIGN PATENT DOCUMENTS

| | | |
|---|---|---|
| CN | 103552656 | 2/2014 |
| DE | 20311223 | 11/2014 |
| JP | 6263150 | 9/1994 |

OTHER PUBLICATIONS

Frontenac Outfitters Canoe and Kayak Centre, Kayak Parts and Terminology, frontenac-outfitters.com, http://frontenac-outfitters.com/kayaks-2/kayak-parts-terminology, Ontario, accessed on Aug. 2014.

(Continued)

*Primary Examiner* — Daniel V Venne

(74) *Attorney, Agent, or Firm* — Workman Nydegger

(57) ABSTRACT

A watercraft includes a molded hull in the form of a single-piece hollow plastic structure, and the hull defines a recess having an interior. An insert is also provided that defines an opening and is attached to the hull. The insert is positioned with respect to the recess such that the opening in the insert communicates with the interior of the recess, and the insert cooperates with the recess to define an undercut that accommodates a portion of a hand of a user.

16 Claims, 8 Drawing Sheets

(56) References Cited

U.S. PATENT DOCUMENTS

| | | | | |
|---|---|---|---|---|
| 7,735,442 | B2 | 6/2010 | Richter | |
| 8,082,869 | B2 | 12/2011 | Beaty | |
| 8,616,142 | B2 | 12/2013 | Eckert et al. | |
| 8,777,683 | B2 | 7/2014 | Friedman | |
| 8,800,468 | B2 | 8/2014 | VanNimwegen et al. | |
| 9,120,218 | B1 * | 9/2015 | Stehlik | B25G 1/10 |
| 2002/0166493 | A1 * | 11/2002 | Sorensen | B63B 35/71 114/343 |
| 2008/0105189 | A1 | 5/2008 | Richter | |
| 2012/0122357 | A1 | 5/2012 | Eckert et al. | |
| 2013/0017743 | A1 | 1/2013 | Green et al. | |
| 2013/0048821 | A1 | 2/2013 | Leet et al. | |
| 2013/0074760 | A1 | 3/2013 | VanNimwegen et al. | |
| 2013/0130578 | A1 | 5/2013 | Friedman | |

OTHER PUBLICATIONS

Douglas Wilcox, Malin Gometra sea kayak long term test and comparative review, Oct. 14, 2013, playak.com, http://playak.com/news.php?idd=2666561627522, accessed on Aug. 2014.

Jupiter Kite/Paddle/Wake, Lift SUP Retractable Paddleboard Handle, www.jupiterkiteboarding.com, http://www.jupiterkiteboarding.com/store/lift-retractable-paddleboard-handle-p-3068.html, accessed on Aug. 2014.

Kayarchy, Sea kayaks vs. other kayaks and canoes, www.kayarchy.co.uk, http://www.kayarchy.co.uk/html/01equipment/010otherkayaks.htm, accessed on Aug. 2014.

Sherri Mertz, Everything You Need to Know About End Toggles, But Never Knew to Ask (Part I), Apr. 16, 2012, www.sherrikayaks.com, http://www.sherrikayaks.com/2012/04/16/everything-you-need-to-know-about-end-toggles-but-never-knew-to-ask-part-i/, accessed on Aug. 2014.

Vincent S. Rinando Jr., Product Review: Necky Vector 13, Jan. 4, 2011, www.austinkayak.com, http://www.austinkayak.com/blog/2011/01/product-review-necky-vector-13/, accessed on Aug. 2014.

Teksport, Kayak Handle (Stainless Steel-Plastic Style), www.teksport.co.uk, http://www.teksport.co.uk/Kayak+Handle+(stainless+steel+plastic+style/0_CAAA002/PRAA003.htm, accessed on Aug. 2014.

International Search Report and Written Opinion of PCT/US2015/046577, dated Nov. 30, 2015, filed Aug. 24, 2015.

* cited by examiner

WATERCRAFT WITH UNDERCUT GRIP INSERT

FIELD OF THE INVENTION

The present invention generally relates to watercraft, such as paddleboards, suitable for use in water sports or other activities. One or more aspects of example embodiments may also find application in watercraft such as, but not limited to, kayaks, sailboats, surfboards, paipo boards, boards for wind surfers, kneeboards, wakeboards, and bodyboards, examples of which include boards referred to as boogie boards.

BACKGROUND

The size and/or shape of some types of watercraft can make them awkward to handle and transport when they are not in use. Accordingly, such watercraft can be equipped with some type of handle or handhold to better facilitate handling and transportation. Depending upon the nature of the construction of the watercraft however, the manufacturing of such handles or handholds can be problematic.

For example, some types of watercraft, such as paddleboards and kayaks, for example, have a blow molded construction. The blow molded construction may be desirable because it produces a light and strong structure. However, some blow-molding processes are unable to create an undercut configuration that a user can readily grasp and hold. Instead, the blow-molding process may only form a recess or indentation that lacks an undercut for a user to grip.

Thus, while a blow-molding process can form a grip that a user can grasp in an attempt to handle and transport the watercraft, that grip is not particularly effective. Moreover, the effectiveness of the grip is likely to be reduced further when the watercraft is wet since the grip can tend to slip out of the hand of the user. This undesirable result is particularly likely where the watercraft is relatively heavy and/or has an unwieldy shape.

Accordingly, what is needed is a grip that includes an undercut structure that can enable a user to readily grasp and hold the watercraft, or other structure, where the grip is employed. The grip may be particularly useful when employed in connection with blow-molded or other structures where formation of an undercut is difficult, or impossible.

BRIEF SUMMARY OF ASPECTS OF SOME EXAMPLE EMBODIMENTS

Various disclosed embodiments are concerned with various types of watercraft, examples of which include, but are not limited to, kayaks, sailboats, surfboards, paipo boards, boards for wind surfers, kneeboards, wakeboards, and bodyboards, examples of which include boards referred to as boogie boards. Other embodiments are directed more generally to any blow-molded structure that may benefit from the inclusion of one or more grips such as are disclosed herein, where such blow-molded structures may include, for example, panels and tables.

The embodiments disclosed herein do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

In particular, example embodiments within the scope of this disclosure may include one or more of the following elements, in any combination: a blow-molded element having a unitary-one piece structure that is substantially hollow; a watercraft hull including a portion that is blow-molded, where the blow-molded portion is in the form of a unitary, one-piece structure that is substantially hollow; a blow-molded watercraft hull in the form of a unitary, one-piece structure that is substantially hollow; a blow-molded hull portion in the form of a unitary, one-piece structure that is substantially hollow, where the blow-molded hull portion defines a recess; an insert configured to be disposed with respect to a recess such that the insert and recess cooperatively define an undercut that can be gripped by a user; an insert comprising one or more of plastic, rubber, or metal; an insert configured to be received within a recess defined in a structure that may be blow-molded; an insert configured to be received with a recess so that an upper surface of the insert is substantially flush with the surrounding structure in which the recess is defined; an insert that defines an opening configured to communicate with a recess defined by a structure when the insert is positioned proximate the recess; and, an insert that is removably attachable to a structure.

Any embodiment of a watercraft that includes a hull which is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depression that contact each other and depressions that are spaced apart from each other may both be present in a watercraft. The depressions may be sized and configured to strengthen and/or reinforce the blow-molded plastic hull of the watercraft. Following is a brief listing of some example embodiments. Finally, and more generally, such tack-offs can be included in any other blow-molded structure.

In a first example embodiment, a blow-molded element is provided that has a unitary-one piece structure that is substantially hollow, and a grip for the blow-molded element is provided that includes an undercut that is defined in part by the blow-molded element.

In a second example embodiment, a blow-molded element is provided that has a unitary-one piece structure that is substantially hollow, and a grip is provided that includes an undercut that is cooperatively defined by a recess in the blow-molded element and an insert disposed proximate the recess.

In a third example embodiment, a watercraft comprises a hull that is in the form of a blow-molded structure having a unitary-one piece construction that is substantially hollow, and a grip is provided that includes both an insert as well as a recess defined by the unitary-one piece structure, and the recess cooperates with the insert to define an undercut that can be gripped by a user.

In a fourth example embodiment, a watercraft comprises a hull which is in the form of a blow-molded element with a unitary-one piece structure that is substantially hollow. A grip is provided that includes an insert, and also includes a recess defined by the unitary-one piece structure. The recess cooperates with an opening in the insert to define an undercut that can be gripped by a user.

In a fifth example embodiment, a watercraft comprises a hull which is in the form of a blow-molded element with a unitary-one piece structure that is substantially hollow. A grip is provided that includes an insert, and also includes a recess defined by the unitary-one piece structure. The insert is received in a portion of the recess so that an upper surface of the insert is substantially flush with the surrounding structure that defines the recess, and the recess cooperates with an opening in the insert to define an undercut that can be gripped by a user.

In a sixth example embodiment, a method of making a watercraft is performed, where the method includes forming a plastic hull using a blow-molding process, where forming the hull includes forming a recess in the hull. The method also includes attaching an insert to the plastic hull of the watercraft so that an opening defined in the insert communicates with an interior of the recess, and the insert cooperates with the recess to define an undercut that is sized and arranged to accommodate part of a hand of a user.

In a seventh example embodiment, the method performed in the sixth example embodiment forms a recess that is free of any undercuts.

In an eighth example embodiment, the method performed in the sixth example embodiment forms the recess as part of a tack-off.

In a ninth example embodiment, the method performed in the sixth example embodiment forms the plastic hull as a substantially hollow structure.

In a tenth example embodiment, the method performed in the sixth example embodiment further includes forming the insert.

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. The invention will be described and explained with additional specificity and detail through the use of the accompanying drawings in which.

DETAILED DESCRIPTION OF EXAMPLE EMBODIMENTS

Embodiments of the invention generally relate to watercraft, such as paddleboards, for example, suitable for use in water sports or other activities. One or more aspects of example embodiments may also find application in watercraft, such as, but not limited to, kayaks, sailboats, surfboards, paipo boards, boards for wind surfers, kneeboards, wakeboards, and bodyboards, examples of which include boards referred to as boogie boards. In one particular example, one or more embodiments take the form of a sit-on-top kayak or watercraft, and yet other embodiments take the form of a sit-inside kayak or watercraft.

More generally still, embodiments of the invention can extend to any blow-molded structure where a grip may be useful, and the scope of the invention is not limited to watercraft. Such other blow-molded structures include, but are not limited to, blow-molded panels, blow-molded tables, and/or any other blow-molded structures where one or more grips within the scope of this disclosure may be useful.

A. Aspects of Various Example Watercraft

Figure 1A:
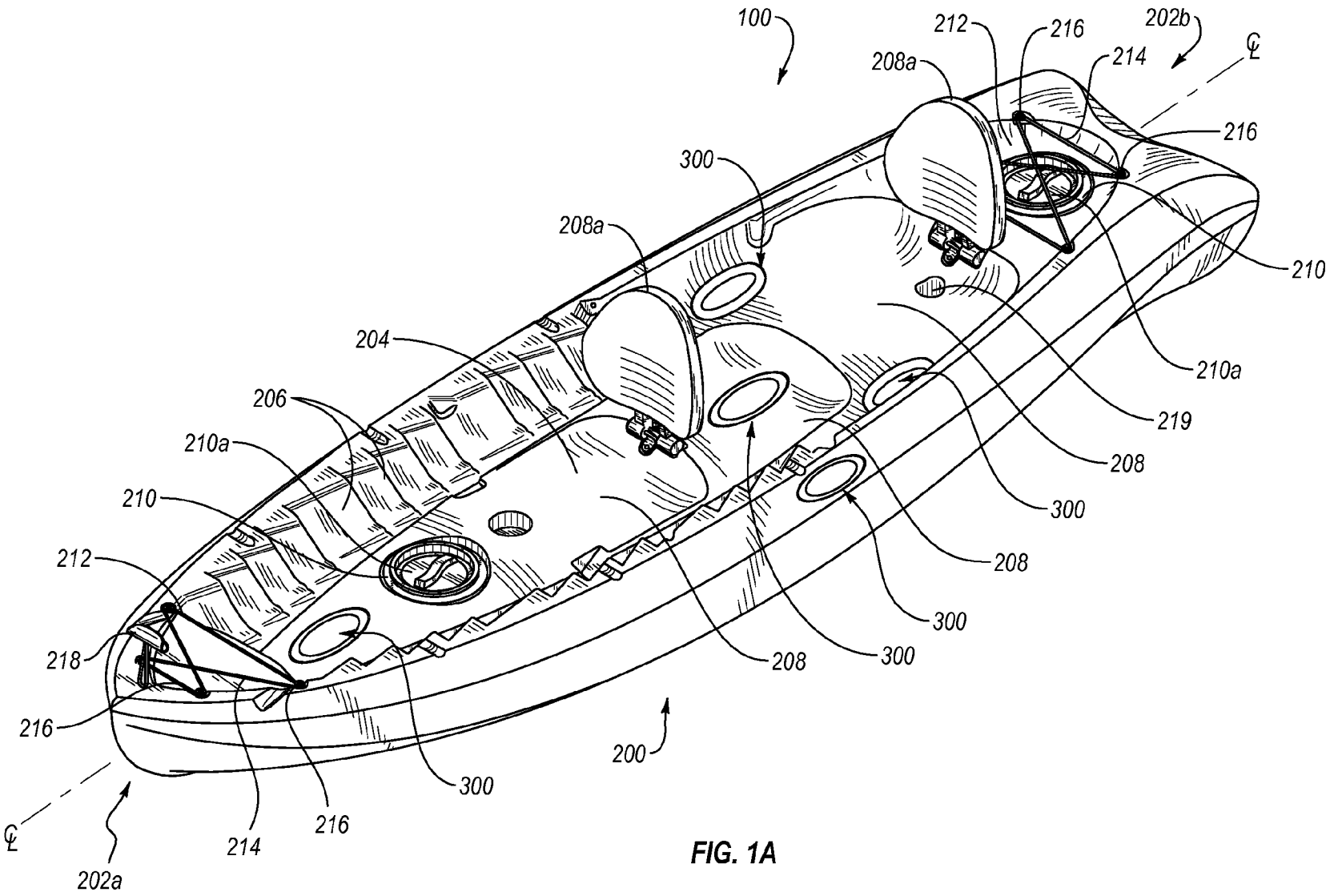
FIG. 1*a* is a top perspective view of an example kayak that includes one or more grips.
Figure 1B:
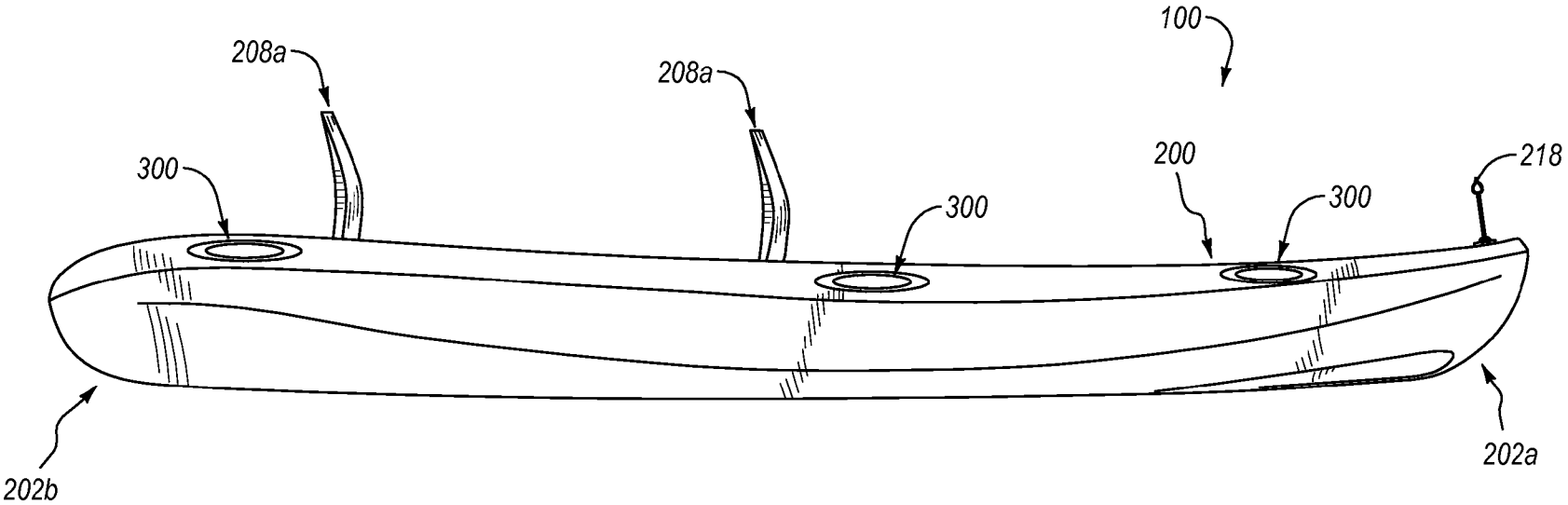
FIG. 1*b* is side view of an example kayak that includes one or more grips.

With particular reference first to FIGS. 1*a* and 1*b*, an example watercraft 100 is disclosed that includes a hull 200. In the example of FIGS. 1*a* and 1*b*, the watercraft 100 takes the form of a sit-on-top kayak, although the scope of the invention is not limited to that particular watercraft. Some or all of the hull 200 may be constructed of blow-molded plastic that defines an interior that is partially or completely hollow. However, other processes, such as roto-molding, vacuum molding, twin sheet molding, and drape molding, for example, may be employed in the construction of any of the embodiments disclosed herein, and the scope of this disclosure is not limited to any particular manufacturing process(es).

The hull 200 may be any size and/or shape desired, and the Figures provided herewith simply disclose example configurations. In the example of FIGS. 1*a* and 1*b*, the hull 200 is a single piece of blow-molded plastic that includes a bow 202*a* and a stern 202*b*. The hull 200 may include, among other things, a cockpit 204, and one or more foot wells 206 on either side of the cockpit 204. In general, the foot wells 206 may be configured and arranged to provide support for the feet of a user. In some embodiments, the foot wells 206 may be integrally formed with the hull 200. Aspects such as the size, geometry, orientation, number, location and spacing of the foot wells 206 can be selected as desired. Among other things, the foot wells 206 may enable a user to position his or her feet in a variety of different locations within the cockpit 204. This flexibility in positioning may prove useful where considerations such as physical size and paddling style can vary from one user to another. As well, different water, wind and other environmental conditions may dictate changes in the foot position of a user.

Embodiments of the watercraft 100 may also have one, two, or more, seats 208. In the particular example of FIG. 1, three seats 208 are provided, although more or fewer seats may be provided in other embodiments. In some embodiments, the seats 208 may be integrally formed with the hull 200. One or more of the seats 208 may be sized and oriented to accommodate an adult passenger. As well, one or more of the seats 208 may be associated with a respective backrest 208*a* that may be rotatable relative to the hull 200.

Some embodiments of the watercraft 100 may include one or more internal storage areas 210 in the interior of the body 200 and accessible by way of a removable cover 210*a*, which may be threaded or otherwise configured to releasably engage corresponding structure of the body 200. Moreover, embodiments of the watercraft 100 may include one or more stowage areas 212 where cargo can be secured, for example, by way of retention devices 214 such as elastic cords or other elements releasably connected to attachment points 216. At least some embodiments of the watercraft 100 may include a handle 218 to enable a user to pull and otherwise maneuver the watercraft 100. Finally, embodiments of the watercraft 100 can include one or more scuppers 219, which can be formed as a tack-off, and which may enable collection and removal of water that enters the watercraft 100.

Figure 2A:
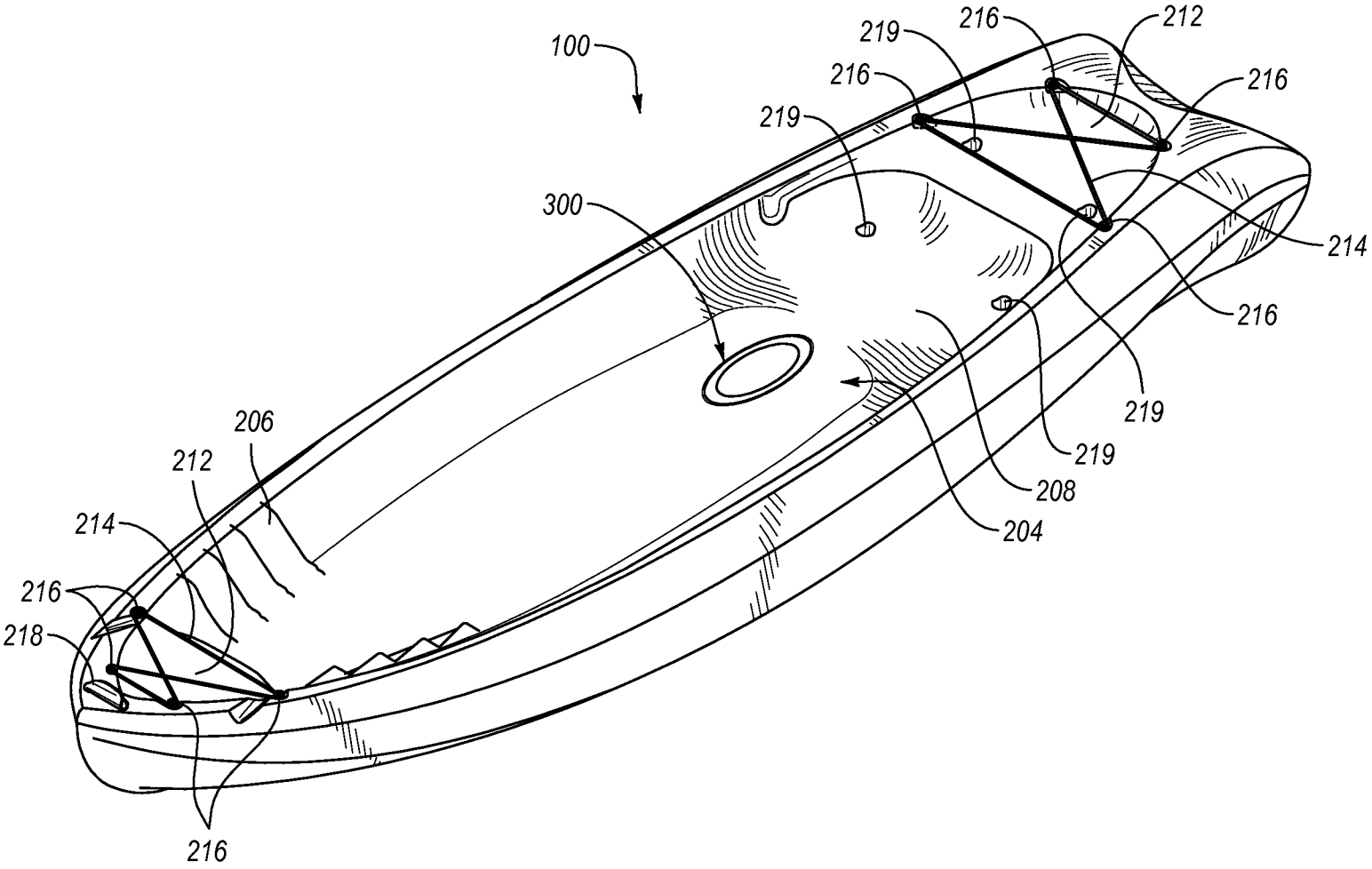
FIG. 2*a* is a rear perspective view of an example kayak including a grip.
Figure 2B:
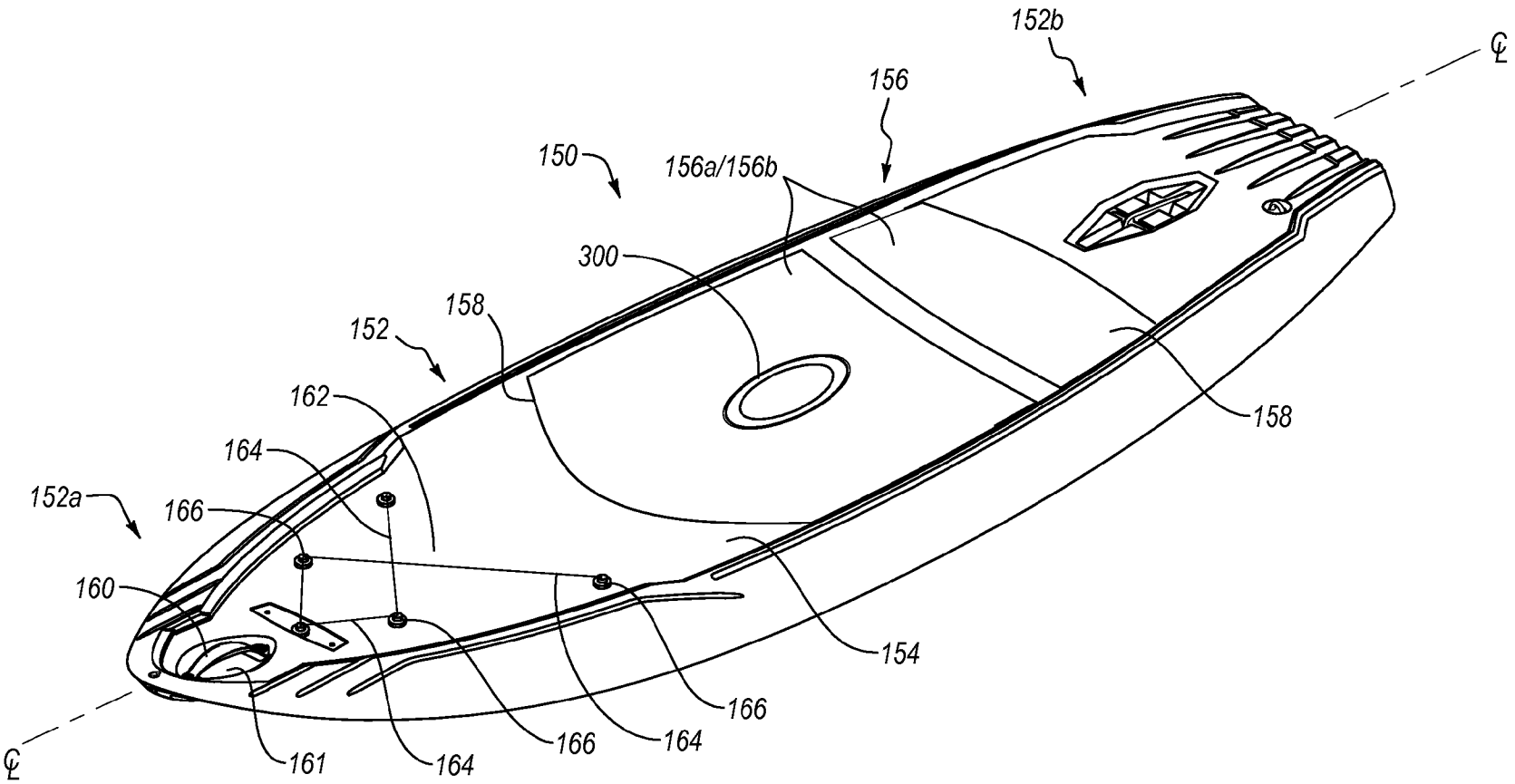
FIG. 2*b* is a front perspective view of an example paddleboard including a grip.

Turning briefly now to FIGS. 2*a* and 2*b*, and with continuing reference to FIGS. 1*a* and 1*b*, details are provided concerning further example embodiments of a watercraft. The embodiment of FIG. 2*a*, similar to the embodiment of FIGS. 1*a* and 1*b*, is directed to a sit-on-top kayak and the embodiment of FIG. 2*a* may accordingly include any, or all, of the features of the embodiment of FIGS. 1*a* and 1*b*, in any combination. The reverse is likewise true, that is, the embodiment of FIGS. 1*a* and 1*b* may include any, or all, of the features of the embodiment of FIG. 2*a*, in any combination. Thus, the numbering of elements in FIGS. 1*a* and 1*b* is carried over to FIG. 2*a*, where applicable.

In general, the embodiment of FIG. 2*a* includes a single grip 300, embodiments of which are discussed in more detail below, located in the cockpit 204 on, or near, the centerline of the watercraft 100. Thus located, the grip 300 can be readily accessed by a user and enables a user to grip and retain the watercraft 100, for example, when the user is carrying the watercraft 100 under his arm. As elsewhere herein, the grip 300 can be located elsewhere on the watercraft 100 and/or additional grips 300 can also be provided.

Turning now to FIG. 2*b*, a watercraft 150 is disclosed. In this particular embodiment, the watercraft 150 takes the form of a paddleboard. The watercraft 150 includes a hull 152. Some or all of the hull 152 may be constructed of blow-molded plastic that defines an interior that is partially or completely hollow. However, other processes, such as roto-molding, vacuum molding, twin sheet molding, and drape molding, for example, may be employed in the construction of any of the embodiments disclosed herein, and the scope of this disclosure is not limited to any particular manufacturing process(es).

The hull 152 may be any size and/or shape desired, and the Figures provided herewith simply disclose one example configuration. In the example of FIG. 2*b*, the hull 152 is a single piece of blow-molded plastic that includes a bow 152*a* and a stern 152*b*. The hull 152 includes an upper surface 154 that defines a deck 156 that can include deck portions 156*a* and 156*b*. One or both of the deck portions 156*a* and 156*b* may include one or more surface treatments 158, examples of which include ethylene-vinyl acetate (EVA) foam decking, ABS sheeting and polyethylene sheeting. Other surface treatments, such as texturing, for example, may be formed as part of a blow-molding, or other molding, process. In one example of a surface treatment that may be included in any embodiment, the surface treatment may be configured to provide a grippable surface for a user so that the user can more readily maintain his grip or footing on the deck 156. The deck portions 156*a* and 156*b* may have different respective surface treatments, or the deck portions 156*a* and 156*b* may have the same surface treatments.

In another example of a surface treatment, portions of the watercraft 150, including the deck 156, may have one or more surfaces with a chemically etched textured portion that provides traction and may allow for elastomeric sheathing to be adhered. In still further examples, one or more surfaces of the watercraft 150 are textured, and the sheathing or other covering may be omitted. It should be noted that one, some, or all of the aforementioned surface treatments can also be employed with any of the surfaces of a kayak, such as the example kayaks of FIGS. 1*a*, 1*b* and 2*a*.

With continued reference to FIG. 2*b*, the example watercraft 150 can further include any one or more of a handle 160 positioned over a recess 161, a stowage area 162, retention devices 164 such as elastic cords or other elements releasably connected to attachment points 166.

Finally, the example watercraft 150 can include one or more grips 300. In the example of FIG. 2*b*, the grip 300 is located in the deck 156 and an insert of the grip, discussed elsewhere herein, protrudes slightly above the deck 156. Alternatively, the insert can be substantially flush with the deck 156 surface. In the example of FIG. 2*b*, the grip 300 is located at, or near, the centerline of the watercraft 150, although that is not required. As well, the grip 300 may be located at, or near, the fore and after center of gravity although, again, that is not required. Moreover, additional grips can also be employed in addition to the grip disclosed in FIG. 2*a*. These additional grips, if any, can be located, for example, in the deck 156 fore and/or aft of the illustrated grip 300 and/or outboard of the illustrated grip 300.

B. Aspects of Some Example Grip Arrangements

With continued reference now to FIGS. 1*a* and 1*b*, and as briefly noted above, the watercraft 100 may include one or more grips 300. In general, the grip 300 or grips 300 are configured and located to enable a user to readily grasp and hold the watercraft 100. Thus, the grips 300 may be particularly useful where the watercraft 100 is relatively heavy and/or has an unwieldy shape. More particularly, at least some embodiments of the grip 300 include an undercut structure that can enable a user to readily grasp and hold the watercraft, or other structure, where the grip is employed. This grip 300 structure may be particularly useful when employed in connection with blow-molded structures or other types of molded structures where formation of an undercut is difficult, or impossible.

As indicated in FIGS. 1*a* and 1*b*, one or more grips 300 can be provided in any desired location(s). Thus, one or more grips 300 can be located on the outside of the hull 200 and/or in the interior of the hull 200, such as in the cockpit 204, for example.

In at least some embodiments, one or more grips 300 may be located inside the hull 200 and/or on the outside of the hull 200, near a fore and aft center of gravity ("CG") so that a user employing the grip 300 can readily find a point of balance, in the fore and aft direction, and thus avoid the problem of dragging either the bow 202*a* or stern 202*b* when the user is carrying the watercraft 100. It can be difficult in some circumstances to precisely determine the point of balance during manufacturing, however, so the grip 300 may be located such that respective opposite ends of the grip 300 are located on either side, that is, fore and aft, of the fore and aft CG.

As a result of this configuration, a user can simply move his hand longitudinally within the grip 300 until the point of balance is found. To this end, at least some embodiments of the grip 300 may be relatively long, such as from about 6 inches long to about 12 inches long, and one particular embodiment of the grip 300 is about 9 inches long. Of course, other dimensions can alternatively be used.

With continued reference to FIGS. 1*a* and 1*b*, a variety of grip combinations and arrangements can be employed, and any combination of the grips 300 indicated in FIGS. 1*a* and 1*b* can be employed. The following are illustrative, but not limiting, examples, and it should be noted that where a single grip 300 is referred to in any of these examples, multiple grips 300 may be employed, and vice versa; a grip 300 on the outside of the hull 200 on either, or both, sides of the watercraft 100; a grip 300 in the interior of the hull 200 on either, or both, sides of the watercraft 100; a grip 300 in the interior of the hull 200 and located near the centerline of the watercraft 100; a grip 300 located at, or proximate, the fore and aft CG; a grip 300 forward, or aft, of the fore and aft CG;

C. Aspects of Some Example Grips

Figure 3A:
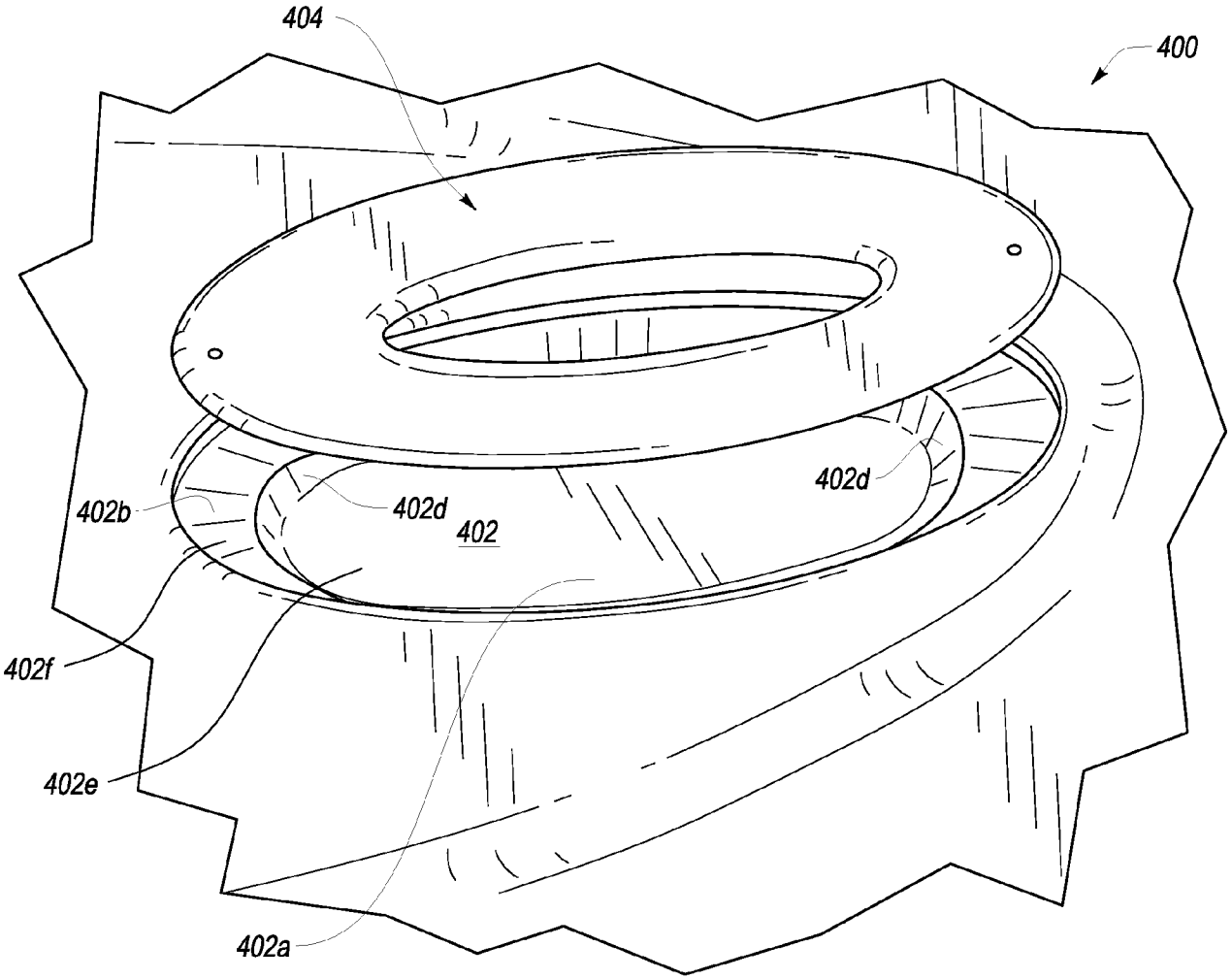
FIG. 3*a* is an exploded perspective view of an example grip.
Figure 3C:
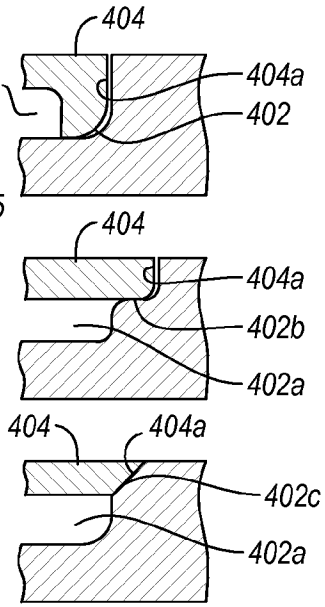
FIG. 3*c* discloses various example interfaces between inserts and recesses.
Figure 3B:
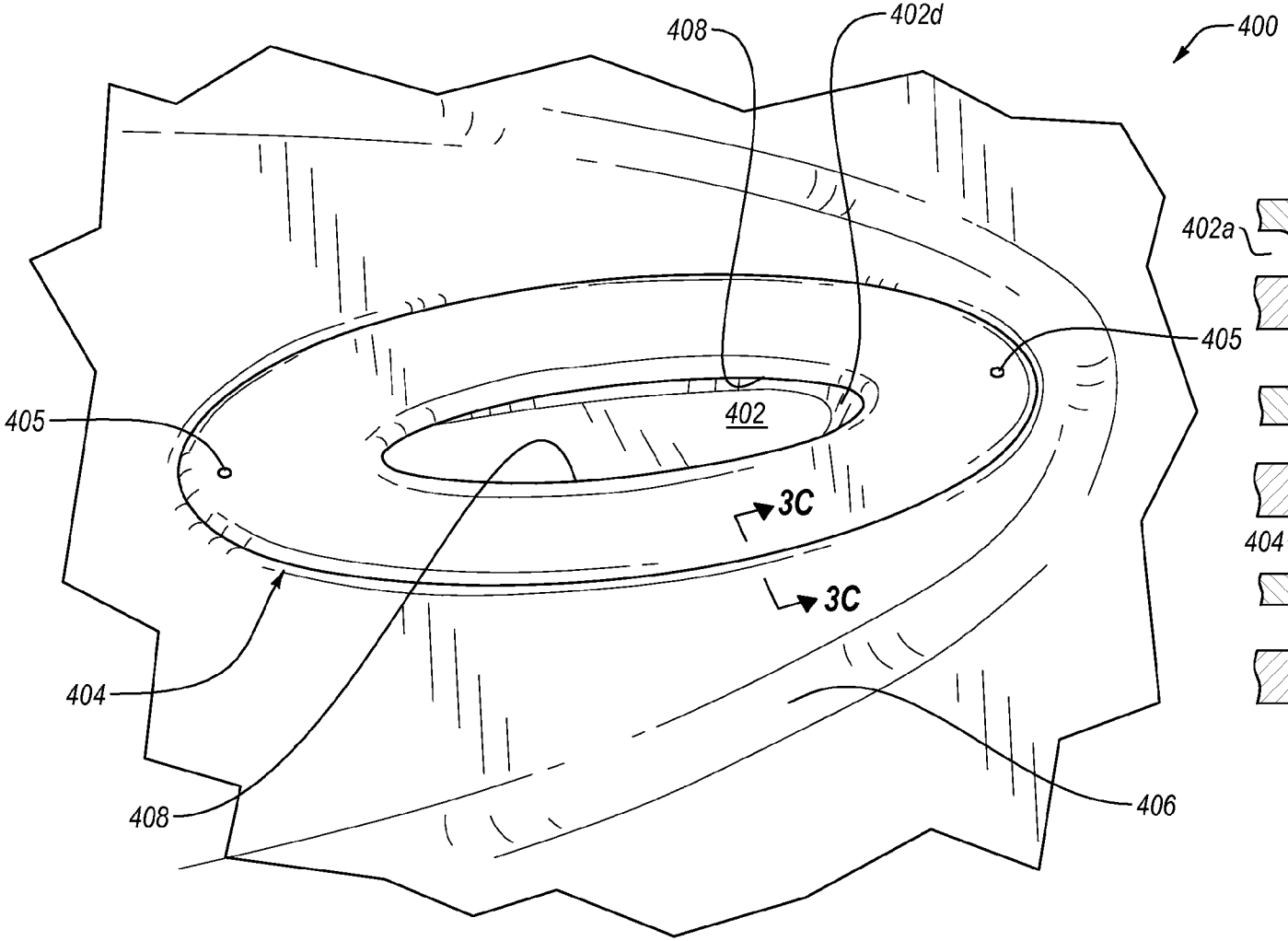
FIG. 3*b* is an assembled perspective view of an example grip.

With reference now first to FIGS. 3*a*-3*d*, details are provided concerning some example grip configurations, denoted generally at 400. As indicated there, a grip 400 may include a recess 402 having an interior 402*a* which receives at least a portion of an insert 404. The recess 402 may, but need not, be defined within a larger recess 406. The recess 402 is defined in, and integral with, the structure of the hull 200. The recess 402 may be formed during a blow-molding, or other molding, process used to form the hull 200, and the recess 402 can have any desired shape, examples of which include oval, round, or rectangular. The shape, length, width and/or depth of the recess 402 can be dictated at least in part by considerations such as the desired length of the grip 400, and the desired width and depth of the grip 400. In example embodiments, the length, width and depth of the grip 400 are such as to enable the grip 400 to readily accommodate a portion of the hand of an adult, such as, for example, two or more fingers up to the second knuckle.

Where the example recess 402 has a generally elongate form, as indicated in FIGS. 3*a* and 3*b*, the longer dimension of the recess 402 can be oriented generally in a fore and aft direction, although that is not required. In some embodiments, the recess 402 has a substantially uniform depth throughout, although in other embodiments, the depth can vary across the width and/or length of the recess 402.

The recess 402 can be configured in a variety of ways to receive and support the insert 404. As shown in the detail views of FIG. 3*c*, one embodiment of the recess 402 is configured such that a shoulder 402*b* extends around at least a portion of the recess 402, such as the ends and/or sides of the recess 402, so as to support a portion, or all of an edge of the insert 404. In particular, and clearly indicated in the middle view of FIG. 3*c*, the shoulder 402*b* has a step shaped configuration that supports an outer edge 404*a* of the insert 400. In an alternative embodiment, also shown in FIG. 3*c*, the recess 402 is configured with a sloping wall 402*c* that defines an angle substantially the same as an angle defined by an edge 404*a* of the insert 404. Thus, the wall 402*c* and edge 404*a* can cooperate to limit the extent to which the insert 404 can be moved downward into the recess 402, such that the underside of the insert 404 may reside above the bottom of the recess 402. In yet another alternative embodiment, also shown in FIG. 3*c*, the recess 402 is configured so that the insert 404 resides in contact with the bottom of the recess 402.

With continued reference to the Figures, the recess 402 may be configured, as noted above, so that a depth of the recess 402 varies. As shown in FIG. 3*b*, for example, the recess 402 can include one or more walls 402*d* that extend from the bottom of the recess 402 up to a location at, or near, the underside of the insert 404. As a result of this configuration, and as discussed below, an undercut cooperatively defined by the insert 404 and recess 402 may be defined over only a portion, and not the entirety, of the perimeter of the insert 404. With particular reference to FIG. 3*a*, another consequence of the presence of the wall 402*d* is that the recess 402 is relatively deeper in a middle portion 402*e* of the recess 402 than at the end portion 402*f* of the recess.

Directing continued attention to FIGS. 3*a*-3*d*, further details are provided concerning the example insert denoted at 404. In general, the insert 404 can be rigid and made of any suitable material, including plastic, metal, rubber or any combination of these. Where the insert 404 is plastic, it can be formed by injection molding or any other suitable process(es). The insert 404 can be permanently attached to the hull 200 with glue or other adhesive. Alternatively, the insert 404 can be removably attached to the hull 200 with fasteners 405, such as screws or rivets, for example.

Figure 3D:
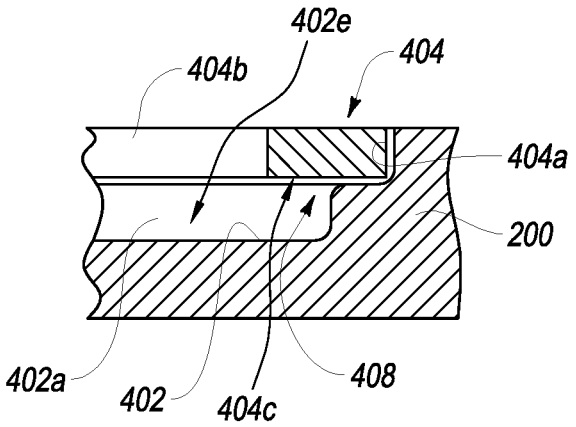
FIG. 3*d* is a partial cross-section showing an example grip undercut.

The insert 404 includes an opening 404*b* arranged to communicate with the interior 402*a* of the recess 402 when the insert 404 is positioned as shown in FIGS. 3*b* and 3*d*, for example. The opening 404*b* can have any suitable size and shape, and is generally an oval shape in the illustrated example. The opening 404*b* can have generally the same shape as the perimeter of the insert 404, but that is not required. The edges of the opening 404*b* may be rounded or otherwise configured to be generally free of sharp edges that could break, or that could cut the hand of a user.

As well, the opening 404*b* is sized and arranged to be generally smaller in length and/or width than the recess 402. Consequently, and as best shown in FIG. 3*c*, a portion of the insert 404 extends over the recess 402 so that the insert 404 and recess 402 cooperatively define an undercut 408. The size and configuration of the undercut 408 can be determined by adjustments to the dimensions of the recess 402 and/or the dimensions of the insert 404. As best shown in FIGS. 3*b* and 3*d*, an upper surface of the insert 404 may be substantially flush with the surrounding structure of the hull 200 that defines the recess 402, although such a configuration is not necessarily required. As best shown in FIG. 3*d*, the insert 404 may be arranged relative to the recess 402 such that part of an underside 404*c* of the insert 404 is spaced apart from a bottom of the middle portion 402*e* of the recess 402.

D. Recess and Tack-Offs

Figure 4:
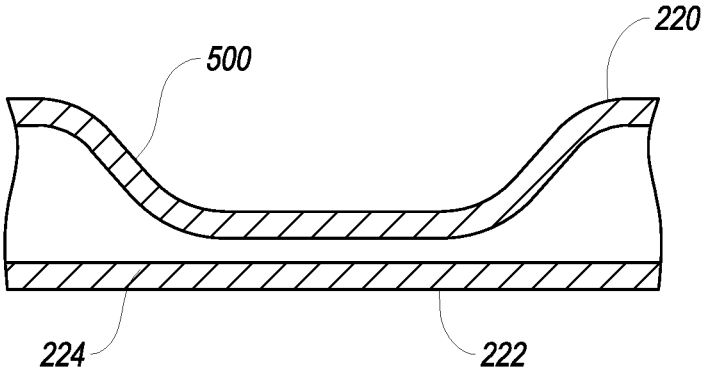
FIG. 4 is a section view disclosing an example recess of a grip, where the recess is in the form of a tack-off.

As noted elsewhere herein, a recess, such as recess 402, for example, may take the form of a tack-off produced by a molding process, such as blow-molding. With reference now to FIG. 4, details are provided concerning an example recess 500 in the form of a tack-off. In the example of FIG. 4, the recess 500 takes the form of a depression that is formed in a first wall 220 of the hull 200 and extends toward a second wall 222 of the hull 200, where the first wall 220 and second wall 222 are spaced apart from each other. A space 224 between the walls 220 and 222 may be hollow. In the example of FIG. 4, the recess 500 is configured so that there is a space between the bottom of the recess 500 and the second wall 222. In an alternative embodiment, the bottom of the recess 500 contacts the second wall 222. In either of these embodiments, the recess 500 is considered as comprising a tack-off.

E. Aspects of an Example Method

Figure 5:
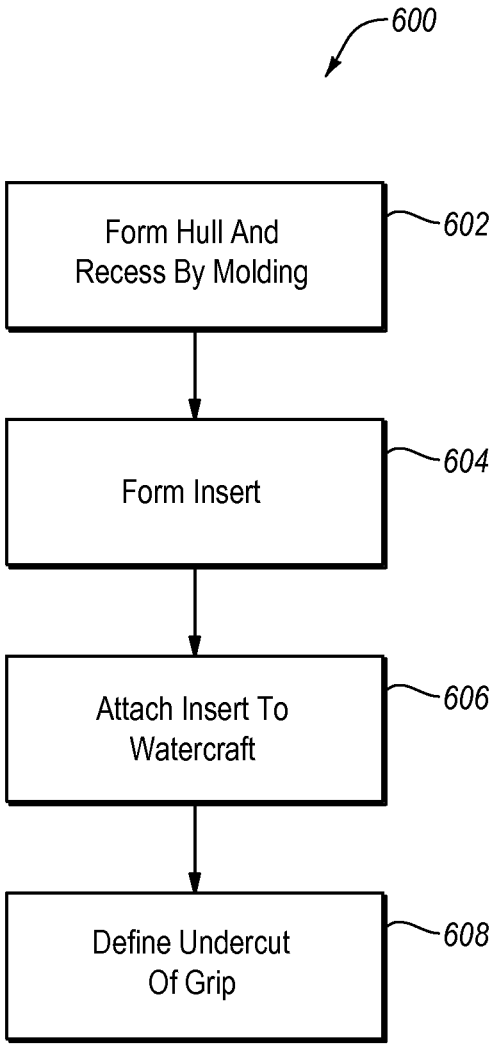
FIG. 5 is a flow diagram disclosing aspects of an example method.

Turning, finally, to FIG. 5, details are provided concerning an example method, denoted at 600, for creating a grip of a molded structure. The example method begins at 602 where a plastic hull of a watercraft is formed using a molding process. The watercraft can be any of the watercraft disclosed herein. In one embodiment, the molding process is a blow-molding process. In other embodiments, however, the molding process can be any of roto-molding, vacuum molding, twin sheet molding, or drape molding. As part of the molding process, one or more recesses are formed in the hull. The hull formed by the molding may be hollow.

The recess formed in the hull during the molding process may be free of any substantial undercuts. As well, the recess may comprise, or be formed as part of, a tack-off in the hull.

Next, an insert is formed 604 that includes an opening. The insert can be formed before, during, or after formation of the hull. A variety of processes can be used to form the insert, one example of which is injection molding, although that is not required.

After the insert has been formed 604, the insert is then attached 606 to the hull proximate the recess so that the insert cooperates with the recess to define 608 an undercut. More particularly, the opening in the insert communicates with an interior of the recess. In general, the undercut is sized and configured to accommodate a portion of a hand of a user. The undercut can have a generally elongate form, but that is not required. The insert can be attached to the hull permanently, by the use of an adhesive, for example. Alternatively, the insert can be removably attached to the hull by use of one or more fasteners.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A watercraft, comprising:

a hull in the form of a unitary one-piece hollow plastic structure, the hull defining a recess having an interior and a side of the recess is defined in part by a shoulder and a wall, and the recess being relatively deeper in a middle portion of the recess than at an end portion of the recess; and an insert that defines an opening located at a center of the insert, and the insert rests on the shoulder above the wall, the insert being positioned with respect to the recess such that the opening in the insert communicates with the interior of the recess, and part of an underside of the insert is spaced apart from a bottom of the middle portion of the recess.

2. The watercraft as recited in claim 1, wherein the watercraft is one of a kayak or a board.

3. The watercraft as recited in claim 1 wherein an upper surface of the insert is substantially flush with the portion of the hull that defines the recess.

4. The watercraft as recited in claim 1, wherein the recess comprises a tack-off.

5. The watercraft as recited in claim 1, wherein the opening defined in the insert extends through the underside of the insert.

6. The watercraft as recited in claim 1, wherein the recess is free of undercuts.

7. The watercraft as recited in claim 1, wherein the watercraft is a kayak comprising a sit-on-top configuration.

8. The watercraft as recited in claim 1, wherein the insert and recess are located proximate a fore and aft center of gravity of the watercraft.

9. The watercraft as recited in claim 1 wherein the insert and opening have an elongate shape that extends fore and aft.

10. The watercraft as recited in claim 1, wherein the insert and recess are located on an outer portion of the hull.

11. The watercraft as recited in claim 1, wherein the watercraft is a paddleboard.

12. A method of making a watercraft, the method comprising:

forming a plastic hull of the watercraft using a molding process, wherein forming the hull includes forming a recess in the hull, and the recess is integrally formed with the hull at the same time as the rest of the hull, the recess having an interior and a side of the recess is defined in part by a shoulder and a wall, and the recess being relatively deeper in a middle portion of the recess than at an end portion of the recess; and after the plastic hull has been formed, attaching an insert to the plastic hull of the watercraft so that an opening defined at a center of the insert communicates with the interior of the recess, the insert resting on the shoulder above the wall, and part of an underside of the insert is spaced apart from a bottom of the relatively deeper portion of the recess, and the insert cooperates with the recess to form a grip that is sized and arranged to accommodate part of a hand of a user.

13. The method as recited in claim 12, wherein the plastic hull is formed as a unitary one-piece structure.

14. The method as recited in claim 12, wherein the recess is formed as part of a tack-off.

15. The method as recited in claim 12, wherein the plastic hull is formed as a substantially hollow structure.

16. The method as recited in claim 12, wherein the molding process is one of blow-molding, roto-molding, vacuum molding, twin sheet molding, or drape molding.

* * * * *